US005122499A

United States Patent [19]

Janssens et al.

[11] Patent Number: 5,122,499

[45] Date of Patent: * Jun. 16, 1992

[54] THERMAL DYE SUBLIMATION TRANSFER PRINTING METHOD

[75] Inventors: Wilhelmus Janssens, Aarschot; Luc J. Vanmaele, Lochristi, both of Belgium

[73] Assignee: Agfa-Gevaert, N.V., Mortsel, Belgium

[ * ] Notice: The portion of the term of this patent subsequent to Aug. 27, 2008 has been disclaimed.

[21] Appl. No.: 623,533

[22] Filed: Dec. 7, 1990

[30] Foreign Application Priority Data

Dec. 12, 1989 [EP] European Pat. Off. ..... 89203158

[51] Int. Cl.[5] ..... B41M 5/035; B41M 5/26

[52] U.S. Cl. ..... 503/227; 428/195; 428/412; 428/480; 428/913; 428/914

[58] Field of Search ..... 8/471; 428/195, 480, 428/483, 913, 914; 503/227

[56] References Cited

U.S. PATENT DOCUMENTS 4,422,854 12/1983 Hähnle et al. ..... 8/471

*Primary Examiner*—Bruce H. Hess
*Attorney, Agent, or Firm*—Breiner & Breiner

[57] ABSTRACT

Thermal dye sublimation transfer printing method whereby dye is selectively transferred from a dye-donor element comprising a mono- or duplo-arylazoaniline dye to a transparent receiver sheet.

13 Claims, No Drawings

THERMAL DYE SUBLIMATION TRANSFER PRINTING METHOD

The present invention relates to thermal dye sublimation transfer, especially to a thermal dye sublimation transfer printing method in which a yellow dye is transferred from a dye-donor element to a transparent receiving element by the application of heat.

Thermal dye sublimation transfer is a recording method in which a dye-donor element provided with a dye layer containing sublimable dyes having heat transferability is brought into contact with a receiver sheet and selectively, in accordance with a pattern information signal, heated with a thermal printing head provided with a plurality of juxtaposed heat-generating resistors, whereby dye from the selectively heated regions of the dye-donor element is transferred to the receiver sheet and forms a pattern thereon, the shape and density of which is in accordance with the pattern and intensity of heat applied to the dye-donor element.

A dye-donor element for use according to thermal dye sublimation transfer usually comprises a very thin support e.g. a polyester support, which may be coated on one or both sides with an adhesive or subbing layer, one adhesive or subbing layer being covered with a slipping layer that provides a lubricated surface against which the thermal printing head can pass without suffering abrasion, the other adhesive layer at the opposite side of the support being covered with a dye layer, which contains the printing dyes.

The dye layer can be a monochrome dye layer or it may comprise sequential repeating areas of different dyes like e.g. cyan, magenta and yellow dyes. Besides areas containing these three primary color dyes, an area containing a black dye, mostly in the form of a mixture of several dyes, can be provided. When a dye-donor element containing three or more dyes is used, a multicolor image can be obtained by sequentially performing the dye transfer process steps for each color.

The dye is transferred to a dye-receiving element that comprises a dye-image-receiving layer provided on a support which may be transparent or reflective.

Any dye can be used in the dye layer provided it is easily transferable to the dye-image-receiving layer of the receiver sheet by the action of heat.

Typical and specific examples of dyes for use in thermal dye sublimation transfer have been described in, e.g., EP 209990, EP 209991, EP 216483, EP 218397, EP 227095, EP 227096, EP 229374, EP 235939, EP 247737, EP 257577, EP 257580, EP 258856, EP 279330, EP 279467, EP 285665, U.S. Pat. Nos. 4,743,582, 4,753,922, 4,753,923, 4,757,046, 4,769,360, 4,771,035, JP 84/78894, JP 84/78895, JP 84/78896, JP 84/227490, JP 84/227948, JP 85/27594, JP 85/30391, JP 85/229787, JP 85/229789, JP 85/229790, JP 85/229791, JP 85/229792, JP 85/229793, JP 85/229795, JP 86/41596, JP 86/268493, JP 86/268494, JP 86/268495 and JP 86/284489.

One of the major problems in selecting a dye for thermal dye sublimation transfer printing is good transfer efficiency to produce high maximum transfer density. Many of the dyes proposed for use in thermal dye sublimation transfer are not suitable because they yield inadequate transfer densities at reasonable coating coverages. Especially for transfer on transparent film materials as receiving element, where the transfer density amounts to only half the transfer density obtained on a reflective receiving element for the same dye at the same coating coverage, the transfer densities obtained are too low.

With the commercially available materials and printers only very low transmission densities for the yellow dye transferred onto transparent film (D lower dan 1.0) are obtained although in some cases special dye-donor elements adjusted for transfer onto transparent film are provided.

It is an object of the present invention to provide yellow dyes for use in thermal dye sublimation transfer printing on transparent film receiver sheets which yield high transfer densities.

This and other objects are achieved in accordance with the present invention by providing a thermal dye sublimation transfer printing method whereby dye is selectively transferred from a dye-donor element to a transparent receiver sheet characterized in that the dye-donor element comprises a mono- or duplo-arylazoaniline dye.

Mono-arylazoaniline dyes according to the present invention can be represented by the following formula (I)

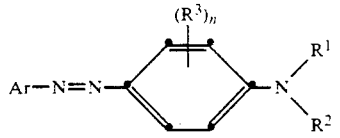

(I)

wherein:

$R^1$ and $R^2$ each independently represent hydrogen, a substituted or unsubstituted alkyl group, a substituted or unsubstituted cycloalkyl group, a substituted or unsubstituted aryl group, a substituted or unsubstituted allyl group, or $R^1$ and $R^2$ together form the necessary atoms to close a 5- or 6-membered heterocyclic ring with the nitrogen to which they are attached, or $R^1$ and/or $R^2$ form with the nitrogen to which they are attached and either or both carbon atoms of the phenyl ring ortho to said nitrogen atom (a) 5- or 6-membered heterocyclic ring(s);

$R^3$ represents a hydroxy group, a halogen atom, a substituted or unsubstituted alkyl group, a substituted or unsubstituted cycloalkyl group, a substituted or unsubstituted aryl group, a substituted or unsubstituted alkoxy group, a substituted or unsubstituted aryloxy group, a substituted or unsubstituted carbonylamino group, a substituted or unsubstituted sulfonylamino group;

n equals 0, 1 or 2; the $R^3$ substituents may be the same or different when n is 2;

Ar represents a substituted or unsubstituted aryl group.

Duplo-arylazoaniline dyes according to the present invention can be represented by the following formula (II)

(II)

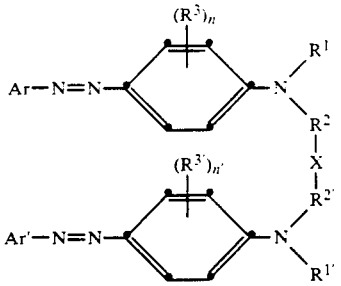

wherein:

$R^1$ represents hydrogen, a substituted or unsubstituted alkyl group, a substituted or unsubstituted cycloalkyl group, a substituted or unsubstituted aryl group, a substituted or unsubstituted allyl group, and $R^2$ represents a substituted or unsubstituted alkylene group, a substituted or unsubstituted cycloalkylene group, a substituted or unsubstituted arylene group, or $R^1$ and $R^2$ together form the necessary atoms to close a 5- or 6-membered heterocyclic ring with the nitrogen to which they are attached, or $R^1$ and/or $R^2$ form with the nitrogen to which they are attached and either or both carbon atoms of the phenyl ring ortho to said nitrogen atom (a) 5- or 6-membered heterocyclic ring(s);

$R^3$ represents a hydroxy group, a halogen atom, a substituted or unsubstituted alkyl group, a substituted or unsubstituted cycloalkyl group, a substituted or unsubstituted aryl group, a substituted or unsubstituted alkoxy group, a substituted or unsubstituted aryloxy group, a substituted or unsubstituted carbonylamino group, a substituted or unsubstituted sulfonylamino group;

n equals 0, 1 or 2; the $R^3$ substituents may be the same or different when n is 2;

Ar represents a substituted or unsubstituted aryl group;

$R^{1'}$, $R^{2'}$, $R^{3'}$, n' and Ar' each can have any of the significances given to $R^1$, $R^2$, $R^3$, n and Ar respectively;

X represents a linking member which can be a chemical bond, a bivalent atom such as O, S, N, or a bivalent atom group such as $SO_2$, $SO_2NH$, NHCONH or a bivalent hydrocarbon group such as alkylene or arylene.

Examples of substituents for Ar and Ar' include halogen, nitro, nitrile, sulfamido, alkyl, cycloalkyl, aryl, alkoxy and aryloxy. Two or more substituents may be linked together so as to form a 5- or 6-membered ring fused-on the aromatic nucleus.

A particularly preferred substituent $R^{3(')}$ is hydroxy in ortho position with respect to the azo link.

Use of duplo-arylazoaniline dyes or use of arylazoaniline dyes containing semi-polar substituents has the advantage of a decreased degree of retro-sublimation, i.e. the re-sublimation in course of time of part of the dye transferred to the receiving sheet from the transferred dye image to a sheet of paper or any other substrate in contact with the dye-receiving layer.

Arylazoaniline dyes according to the above formulae (I) and (II) generally have absorption maxima in the region 410–550 nm and are useful for the printing of yellow-orange shades.

Arylazoaniline dyes included within the scope of the present invention include the following.

TABLE 1

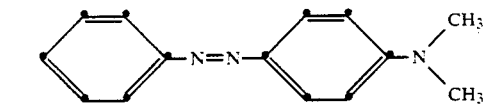

Y1

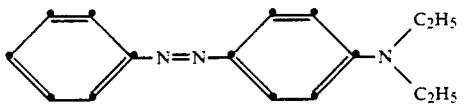

Y2

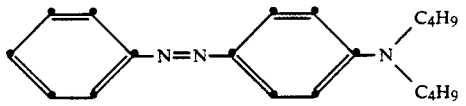

Y3

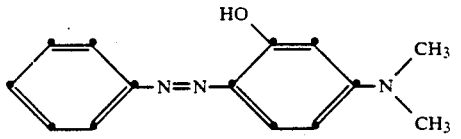

Y4

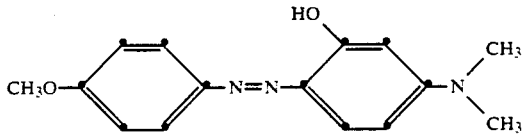

Y5

TABLE 1-continued
Y6
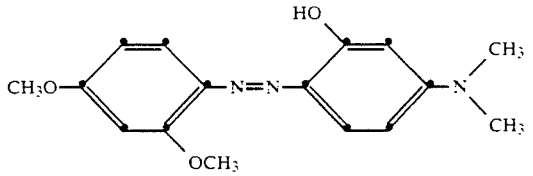
Y7
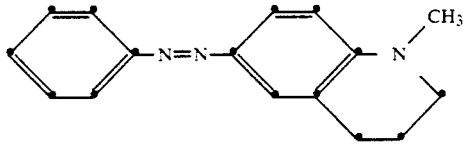
Y8
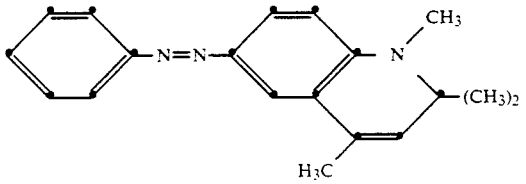
Y9
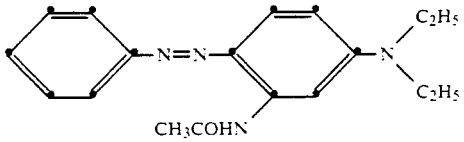
Y10
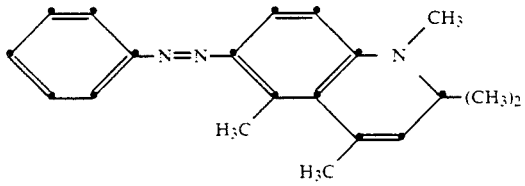
Y11
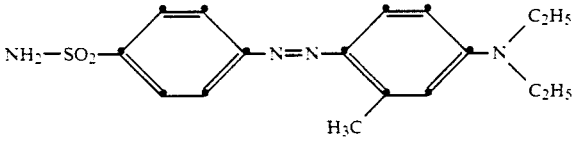
Y12
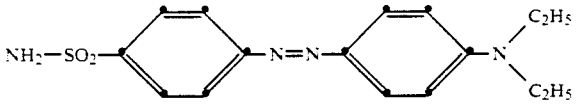
Y13
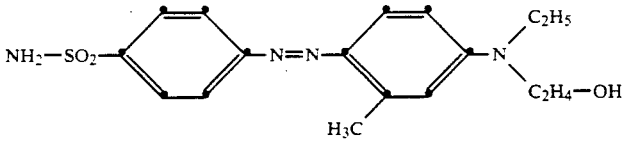
Y14
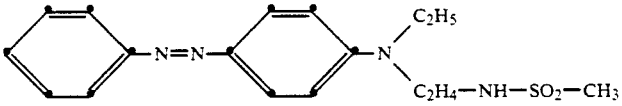
Y15
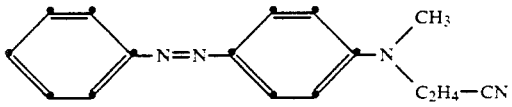

TABLE 1-continued

| | |
|---|---|
| 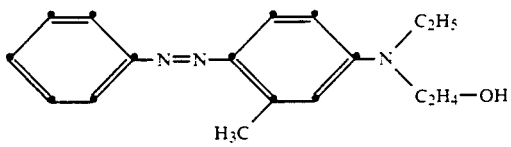 | Y16 |
| 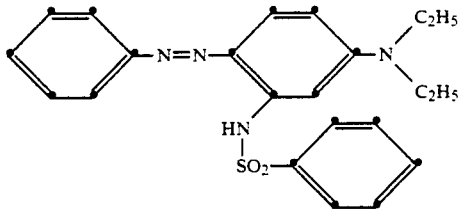 | Y17 |
| 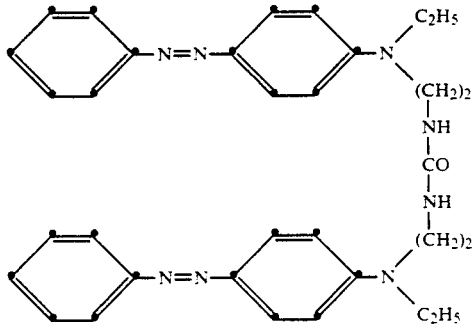 | Y18 |
| 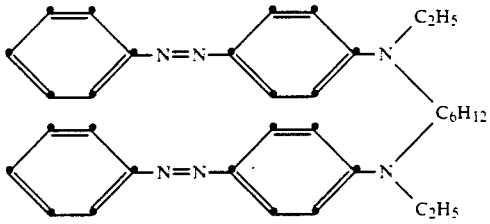 | Y19 |

The dyes listed in the above table may be prepared by synthetic procedures similar to those described in J. Chem. Soc., Perkin Trans. II, 1987, pages 815 to 818, and in J. Chem. Soc., Chem. Comm., 1986, pages 1639 to 1640.

The dye layer of the dye-donor element is formed preferably by adding the dyes, the polymeric binder medium, and other optional components to a suitable solvent or solvent mixture, dissolving or dispersing the ingredients to form a coating composition that is applied to a support, which may have been provided first with an adhesive or subbing layer, and dried.

The dye layer thus formed generally has a thickness of about 0.2 to 5.0 μm, preferably 0.4 to 2.0 μm, and the amount ratio of dye to binder is generally between 9:1 and 1:3 by weight, preferably between 2:1 and 1:2 by weight.

As polymeric binder the following can be used: cellulose derivatives, such as ethyl cellulose, hydroxyethyl cellulose, ethylhydroxy cellulose, ethylhydroxyethyl cellulose, hydroxypropyl cellulose, methyl cellulose, nitrocellulose, cellulose acetate formate, cellulose acetate hydrogen phthalate, cellulose acetate, cellulose acetate propionate, cellulose acetate butyrate, cellulose acetate pentanoate, cellulose acetate benzoate, cellulose triacetate; vinyl-type resins and derivatives, such as polyvinyl alcohol, polyvinyl acetate, polyvinyl butyral, copolyvinyl butyral-vinyl acetal-vinyl alcohol, polyvinyl pyrrolidone, polyvinyl acetoacetal, polyacrylamide; polymers and copolymers derived from acrylates and acrylate derivatives, such as polyacrylic acid, polymethyl methacrylate and styrene-acrylate copolymers; polyester resins; polycarbonates; copolystyrene-acrylonitrile; polysulfones; polyphenylene oxide; organosilicones, such as polysiloxanes; epoxy resins and natural resins, such as gum arabic.

The coating layer may also contain other additives, such as curing agents, preservatives, etc., these and other ingredients being described more fully in EP 133011, EP 133012, EP 111004 and EP 279467.

According to a preferred embodiment of the present invention the dye layer comprises at least one thermal solvent, which is a compound that is solid at room temperature, has a melting point below 140° C. with a sharp transition from the solid to the liquid state, and thus becomes a non-aqueous liquid when heated. When thermal solvents are heated at the places of the dye layer where image-wise heat is supplied, they become liquid so that the transfer of the dye to the contacting receiver sheet is facilitated and at the same time sticking of said dye layer to said receiver sheet is inhibited. Thanks to the facilitated transfer of the dye higher transfer densities are obtained. Suitable examples of thermal solvents are e.g. $C_6$-$C_{12}$ alkanediols, ethylene carbonate, propylene carbonate, sulfamides, and the compounds described in U.S. Pat. No. 3438776, preference being given to 1,10-decanediol and 1,6-hexanediol.

Any material can be used as the support for the dye-donor element provided it is dimensionally stable and capable of withstanding the temperatures involved, up to 400° C. over a period of up to 20 msec, and is yet thin enough to transmit heat applied on one side through to the dye on the other side to effect transfer to the receiver sheet within such short periods, typically from 1 to 10 msec. Such materials include sheets or films of polyester such as polyethylene terephthalate, polyamide, polyacrylate, polycarbonate, cellulose ester, fluorinated polymer, polyether, polyacetal, polyolefin, polyimide, glassine paper and condenser paper. Preference is given to a support comprising polyethylene terephthalate. In general, the support has a thickness of 2 to 30 μm. The support may also be coated with an adhesive or subbing layer, if desired.

The dye layer of the dye-donor element may be coated on the support or printed thereon by a printing technique such as a gravure process.

A dye-barrier layer comprising a hydrophilic polymer may also be employed in the dye-donor element between its support and the dye layer to improve the dye transfer densities by preventing wrong-way transfer of dye towards the support. The dye barrier layer may contain any hydrophilic material which is useful for the intended purpose. In general, good results have been obtained with gelatin, polyacryl amide, polyisopropyl acrylamide, butyl methacrylate grafted gelatin, ethyl methacrylate grafted gelatin, ethyl acrylate grafted gelatin, cellulose monoacetate, methyl cellulose, polyvinyl alcohol, polyethylene imine, polyacrylic acid, a mixture of polyvinyl alcohol and polyvinyl acetate, a mixture of polyvinyl alcohol and polyacrylic acid or a mixture of cellulose monoacetate and polyacrylic acid. Suitable dye barrier layers have been described in e.g. EP 227091 and EP 228065. Certain hydrophilic polymers, for example those described in EP 227091, also have an adequate adhesion to the support and the dye layer, thus eliminating the need for a separate adhesive or subbing layer. These particular hydrophilic polymers used in a single layer in the donor element thus perform a dual function, hence are referred to as dye-barrier/-subbing layers.

Preferably the reverse side of the dye-donor element is coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. The surface active agents may be any agent known in the art such as carboxylates, sulfonates, phosphates, aliphatic amine salts, aliphatic quaternary ammonium salts, polyoxyethylene alkyl ethers, polyethylene glycol fatty acid esters, fluoroalkyl $C_2$–$C_{20}$ aliphatic acids. Examples of liquid lubricants include silicone oils, synthetic oils, saturated hydrocarbons and glycols. Examples of solid lubricants include various higher alcohols such as stearyl alcohol, fatty acids and fatty acid esters. Suitable slipping layers are described in e.g. EP 138483, EP 227090, U.S. Pat. Nos. 4,567,113, 4,572.860, 4,717,711.

The support for the receiver sheet that is used with the dye-donor element according to the present invention is a transparent film of e.g. a polyethylene terephthalate, a polyether sulfone, a polyimide, a cellulose ester or a polyvinyl alcohol-co-acetal or other thermostable sheets. The thickness of the support is generally between 0.05 and 0.2 mm.

To avoid poor adsorption of the transferred dye to the support of the receiver sheet this support must be coated with a special surface, a dye-image-receiving layer, into which the dye can diffuse more readily. The dye-image-receiving layer may comprise, for example, a polycarbonate, a polyurethane, a polyester, a polyamide, polyvinyl chloride, polystyrene-co-acrylonitrile, polycaprolactone or mixtures thereof. Suitable dye-receiving layers have been described in e.g. EP 133011, EP 133012, EP 144247, EP 227094, EP 228066. Preferred dye-image-receiving layers are those comprising polyesters or polycarbonates. The thickness of the receiving layer is generally between 1 and 10 μm.

In order to improve the light resistance and other stabilities of recorded images, UV absorbers, singlet oxygen quenchers such as HALS-compounds (Hindered Amine Light Stabilizers) and/or antioxidants may be incorporated into the receiving layer.

The dye layer of the dye-donor element or the dye-image-receiving layer of the receiver sheet may also contain a releasing agent that aids in separating the dye-donor element from the dye-receiving element after transfer. The releasing agents can also be applied in a separate layer on at least part of the dye layer or of the receiving layer. For the releasing agent solid waxes, fluorine- or phosphate-containing surfactants and silicone oils are used. Suitable releasing agents are described in e.g. EP 133012, JP 85/19138, EP 227092.

The dye-donor elements together with the dye-receiving elements of the present invention are used to form a dye transfer image. Such a process comprises placing the dye layer of the donor element in face-to-face relation with the dye-receiving layer of the receiver sheet and imagewise heating from the back of the donor element. The transfer of the dye is accomplished by heating for about several milliseconds at a temperature of 400° C.

When the process according to the present invention is performed for but one single color, a monochrome yellow dye transfer image is obtained. A multicolor image can be obtained by using a donor element containing three primary color dyes, one of which consists of at least one yellow mono- or duplo-arylazoaniline dye, and sequentially performing the process steps described above for each color. After the first dye has been transferred, the elements are peeled apart. A second dye-donor element (or another area of the donor element with a different dye area) in then brought in register with the dye-receiving element and the process repeated. The third color and optionally further colors are obtained in the same manner.

Instead of thermal heads, laser light, infrared flash or heated pens can be used as the heat source for supplying heat energy. Thermal printing heads that can be used to transfer dye from the dye-donor elements of the present invention to a receiver sheet are commercially available.

The following examples are provided to illustrate the invention in more detail without limiting, however, the scope thereof.

EXAMPLE 1

A dye-donor element was prepared as follows:

A solution of dye as identified in Table 2 and binder, the nature and amount of which is identified below, and optionally 20 mg of a thermosolvent as identified below, in 10 ml of methyl ethylketone was prepared. From this solution a layer having a wet thickness of 100 μm was coated on 5 μm polyethylene terephthalate film. The resulting layer was dried by evaporation of the solvent.

To avoid sticking of the dye-donor element to the thermal printing head the rear side of the polyethylene terephthalate support was coated with a solution comprising 5% co-styrene-acrylonitrile and 0.1% of a 1% solution of polysiloxane polyether copolymer sold under the trade mark TEGOGLIDE 410 by T. H. Goldschmidt, in acetone. From this solution a layer having a wet thickness of 100 μm was coated. The resulting layer was also dried by evaporation of the solvent.

A commercially available material as identified below was used as receiving element.

The dye-donor element was printed in combination with the receiving element in a Hitachi color video printer VY-100A.

The maximum transmission color density of the recorded dye image on the receiving sheet ($D_{trans}$) was measured by means of a Macbeth densitometer Quanta Log using Kodak Wratten filters 92 (red), 93 (green) and 94 (blue).

The experiment was repeated for each of the dye/-binder combinations identified in Table 2.

The results are listed in the following table wherein

B1 stands for nitrocellulose with a nitrogen content between 6.75% and 14.4% by weight as binder;

B2 stands for cellulose acetate butyrate having an acetyl content of 29.5% and a butyryl content of 17% as binder;

T1 stands for 1,10-decanediol as thermosolvent;

R1 stands for Hitachi VY T50A as receiving element;

R2 stands for Bauer COH1-Overhead as receiving element.

R1 as well as R2 comprise a polyethylene terephthalate support and a polyester receiving layer.

TABLE 2

| dye | binder | mg binder/ mg dye | thermosolvent | receiver | $D_{trans}$ |
|---|---|---|---|---|---|
| Y1 | B2 | 20/50 | T1 | R2 | 2.12 |
| Y2 | B1 | 20/50 | T1 | R1 | 2.10 |
| Y2 | B2 | 20/50 | T1 | R2 | 2.44 |
| Y3 | B2 | 20/50 | T1 | R2 | 2.10 |
| Y4 | B1 | 20/50 | / | R1 | 3.01 |
| Y4 | B1 | 20/50 | T1 | R1 | 3.00 |
| Y4 | B1 | 50/50 | / | R1 | 2.20 |
| Y4 | B1 | 50/50 | T1 | R1 | 2.72 |
| Y4 | B2 | 20/50 | / | R1 | 2.80 |
| Y4 | B2 | 50/50 | / | R2 | 2.95 |
| Y5 | B1 | 20/50 | / | R1 | 3.00 |
| Y5 | B1 | 50/50 | / | R1 | 2.00 |
| Y5 | B1 | 50/50 | T1 | R1 | 2.81 |
| Y5 | B2 | 20/50 | / | R2 | 3.02 |

TABLE 2-continued

| dye | binder | mg binder/ mg dye | thermosolvent | receiver | $D_{trans}$ |
|---|---|---|---|---|---|
| Y5 | B2 | 50/50 | / | R2 | 2.64 |
| Y5 | B2 | 50/50 | T1 | R2 | 2.83 |
| Y6 | B1 | 20/50 | / | R1 | 2.51 |
| Y6 | B2 | 20/50 | / | R2 | 2.20 |
| Y6 | B2 | 50/50 | / | R2 | 2.16 |
| Y6 | B2 | 50/50 | T1 | R2 | 2.62 |
| Y7 | B2 | 20/50 | / | R1 | 2.04 |
| Y7 | B2 | 50/50 | T1 | R1 | 2.40 |
| Y7 | B1 | 20/50 | / | R1 | 2.10 |
| Y9 | B2 | 20/50 | / | R1 | 2.34 |
| Y9 | B1 | 20/50 | / | R1 | 2.28 |
| Y9 | B1 | 20/50 | T1 | R1 | 2.54 |

EXAMPLE 2

A comparative dye donor element was prepared as described in example 1. The yellow dye used in this dye donor element was the following:

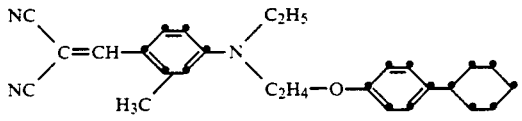

The following results were obtained.

TABLE 3

| binder | mg binder/mg dye | thermosolvent | receiver | $D_{trans}$ |
|---|---|---|---|---|
| B2 | 20/50 | / | R1 | 1.08 |
| B2 | 20/50 | T1 | R1 | 1.44 |
| B1 | 20/50 | / | R1 | 1.18 |
| B1 | 20/50 | T1 | R1 | 1.50 |
| B1 | 50/50 | / | R1 | 0.82 |
| B1 | 50/50 | T1 | R1 | 1.11 |
| B2 | 50/50 | T1 | R1 | 1.37 |

EXAMPLE 3

Comparative tests on the transfer density of the yellow dye of commercially available materials were carried out. The results are listed in table 4.

TABLE 4

| donor element | receiving element | $D_{trans}$ |
|---|---|---|
| Hitachi VY T50A | Hitachi VY-T50A | 0.68 |
| Bauer COH1-Overhead | Bauer COH1-Overhead | 0.90 |
| Mitsubishi CK100TS | Mitsubishi CK100TS | 1.04 |

These commercially receiving elements each comprise a polyethylene terephthalate support and a polyester receiving layer.

These commercially available donor elements respectively comprise the following dyes as yellow dye.

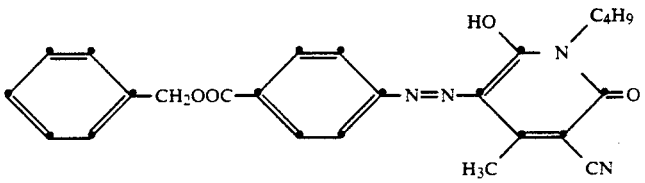

Hitachi VY-T50A

-continued

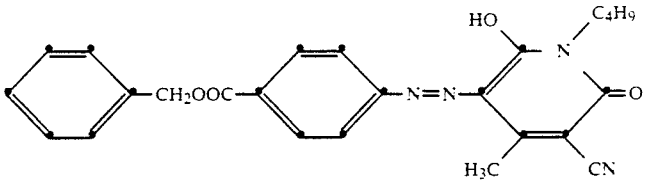

Bauer COH1-Overhead

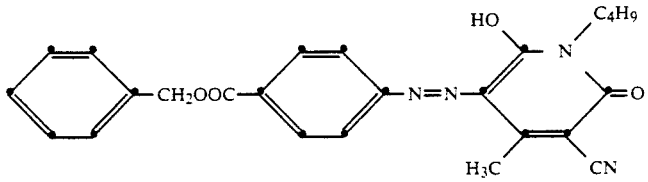

Mitsubishi CK100TS

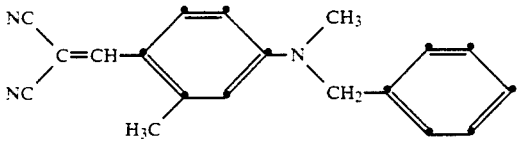

These examples show that the present yellow arylazoaniline dyes yield higher transfer densities on transparent film receiver materials (D higher than 2) than other yellow dyes or commercially available yellow dye donor elements (D less than 2 and even less than 1).

We claim:

1. Thermal dye sublimation transfer printing method comprising the steps of a) superimposing a dye-donor element comprising a support having thereon a dye layer containing a dye over a dye-image-receiving element comprising a transparent support having thereon a dye-receiving layer in such a manner that the dye layer comes into contact with the dye-receiving layer and b) heating the backside of the support of the dye-donor element to selectively transfer at least a portion of the dye to the dye-receiving layer, characterized in that the dye is a yellow-orange mono- or duplo-arylazoaniline dye.

2. Thermal dye sublimation transfer printing method according to claim 1, wherein the mono-arylazoaniline dye corresponds to the following formula

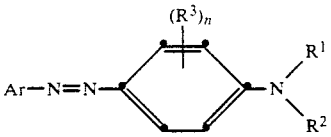

wherein:

$R^1$ and $R^2$ each independently represent hydrogen, a substituted or unsubstituted alkyl group, a substituted or unsubstituted cycloalkyl group, a substituted or unsubstituted aryl group, a substituted or unsubstituted allyl group, or $R^1$ and $R^2$ together form the necessary atoms to close a 5- or 6-membered heterocyclic ring with the nitrogen to which they are attached, or $R^1$ and//or $R^2$ form with the nitrogen to which they are attached and either or both carbon atoms of the phenyl ring ortho to said nitrogen atom (a) 5- or 6-membered heterocyclic ring(s);

$R^3$ represents a hydroxy group, a halogen atom, a substituted or unsubstituted alkyl group, a substituted or unsubstituted cycloalkyl group, a substituted or unsubstituted aryl group, a substituted or unsubstituted alkoxy group, a substituted or unsubstituted aryloxy group, a substituted or unsubstituted carbonylamino group, a substituted or unsubstituted sulfonylamino group;

n equals 0, 1 or 2; the $R^3$ substituents may be the same or different when n is 2;

Ar represents a substituted or unsubstituted aryl group.

3. Thermal dye sublimation transfer printing method according to claim 2, wherein $R^1$ and $R^2$ each represent an alkyl group (same or different), n equals 0 or 1 with $R^3$ representing a hydroxy group when n equals 1 and Ar represents a phenyl group which may be substituted in ortho and/or para position with an alkoxy group.

4. Thermal dye sublimation transfer printing method according to claim 1, wherein the duplo-arylazoaniline dye corresponds to the following formula

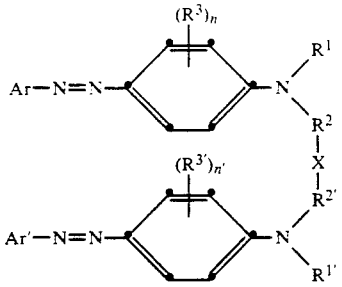

wherein:

$R^1$ represents hydrogen, a substituted or unsubstituted alkyl group, a substituted or unsubstituted cycloalkyl group, a substituted or unsubstituted aryl group, a substituted or unsubstituted allyl group, and $R^2$ represents a substituted or unsubstituted alkylene group, a substituted or unsubstituted cycloalkylene group, a substituted or unsubstituted arylene group, or $R^1$ and $R^2$ together form the necessary atoms to close a 5- or 6-membered heterocyclic ring with the nitrogen to which they are attached, or $R^1$ and/or $R^2$ form with the nitrogen to which they are attached and either or both carbon atoms of the phenyl ring ortho to said nitrogen atom (a) 5- or 6-membered heterocyclic ring(s);

$R^3$ represents a hydroxy group, a halogen atom, a substituted or unsubstituted alkyl group, a substituted or unsubstituted cycloalkyl group, a substituted or unsubstituted aryl group, a substituted or unsubstituted alkoxy group, a substituted or unsubstituted aryloxy group, a substituted or unsubstituted carbonylamino group, a substituted or unsubstituted sulfonylamino group;

n equals 0, 1 or 2; the $R^3$ substituents may be the same or different when n is 2;

Ar represents a substituted or unsubstituted aryl group;

$R^{1'}$, $R^{2'}$, $R^{3'}$, n' and Ar' each can have any of the significances given to $R^1$, $R^2$, $R^3$, n and Ar respectively;

X represents a linking member which can be a chemical bond, a bivalent atom, a bivalent atom group or a bivalent hydrocarbon group.

5. Thermal dye sublimation transfer printing method according to claim 1, wherein the absorption of the mono- or duplo-arylazoaniline dye lies in the range of 410 to 550 nm.

6. Thermal dye sublimation transfer printing method according to claim 1, wherein the dye layer comprises a binder selected from the group consisting of nitrocellulose and cellulose acetate butyrate.

7. Thermal dye sublimation transfer printing method according to claim 1, wherein the dye layer contains a compound that is solid at room temperature and has a melting point below 140° C. with a sharp transition from the solid to the liquid state.

8. Thermal dye sublimation transfer printing method according to claim 1, wherein the support of the dye-donor element consists of polyethylene terephthalate.

9. Thermal dye sublimation transfer printing method according to claim 1, wherein the transparent support of the dye-image-receiving element consists of polyethylene terephthalate.

10. Thermal dye sublimation transfer printing method according to claim 1, wherein the dye-receiving layer of the dye-image-receiving element comprises a polyester or a polycarbonate.

11. Combined kit for use in thermal dye sublimation transfer containing a dye-donor element comprising a support having thereon a dye layer containing a yellow-orange mono- or duplo-arylazoaniline dye and a dye-image-receiving element comprising a transparent support having thereon a dye-receiving layer.

12. Combined kit for use in thermal dye sublimation transfer according to claim 11, wherein the mono-arylazoaniline dye corresponds to the following formula

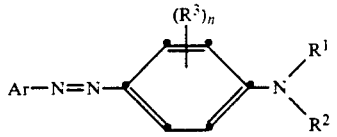

wherein:

$R^1$ and $R^2$ each independently represent hydrogen, a substituted or unsubstituted alkyl group, a substituted or unsubstituted cycloalkyl group, a substituted or unsubstituted aryl group, a substituted or unsubstituted allyl group, or $R^1$ and $R^2$ together form the necessary atoms to close a 5- or 6-membered heterocyclic ring with the nitrogen to which they are attached, or $R^1$ and/or $R^2$ form with the nitrogen to which they are attached and either or both carbon atoms of the phenyl ring ortho to said nitrogen atom (a) 5- or 6-membered heterocyclic ring(s);

$R^3$ represents a hydroxy group, a halogen atom, a substituted or unsubstituted alkyl group, a substituted or unsubstituted cycloalkyl group, a substituted or unsubstituted aryl group, a substituted or unsubstituted alkoxy group, a substituted or unsubstituted aryloxy group, a substituted or unsubstituted carbonylamino group, a substituted or unsubstituted sulfonylamino group;

n equals 0, 1 or 2; the $R^3$ substituents may be the same or different when n is 2;

Ar represents a substituted or unsubstituted aryl group.

13. Combined kit for use in thermal dye sublimation transfer according to claim 11, wherein the transparent support of the dye-image-receiving element consists of polyethylene terephthalate and wherein the dye-receiving layer comprises a polyester or a polycarbonate.

* * * * *